US005765292A

United States Patent [19]

Chan

[11] Patent Number: 5,765,292

[45] Date of Patent: Jun. 16, 1998

[54] HAIR DRYER ATTACHMENT

[75] Inventor: Wing Kin Chan, Kowloon, Hong Kong

[73] Assignee: China Pacific Trade Ltd., Virgin Islands (Br.)

[21] Appl. No.: 808,429

[22] Filed: Feb. 28, 1997

[51] Int. Cl.[6] ..... A45D 20/00

[52] U.S. Cl. ..... 34/98; 34/96; 34/97; 132/212; 285/261

[58] Field of Search ..... 34/90, 96, 97, 34/98, 101; 132/212; 285/261, 272

[56] References Cited

U.S. PATENT DOCUMENTS 5,471,763 12/1995 McArthur ..... 34/96
5,546,674 8/1996 Lange et al. ..... 34/97

*Primary Examiner*—Harold Joyce
*Assistant Examiner*—Pamela A. O'Connor
*Attorney, Agent, or Firm*—Burns, Doane, Swecker & Mathis, L.L.P.

[57] ABSTRACT

An attachment for a hair dryer is provided which is allowed to move relative to the barrel of the hair dryer in use. This is achieved by forming the attachment in two parts, a first part being a tool member for actually performing the desired function of the attachment, and the second part being a connecting member for fixing the attachment to the barrel of the hair dryer. Each of these parts is formed with a complementary part-spherical portion which are disposed one within the other to form a rotatable joint in the manner of a ball-and-socket joint. The attachment can take any of a number of conventional forms.

5 Claims, 8 Drawing Sheets

HAIR DRYER ATTACHMENT

FIELD OF THE INVENTION

This invention relates to a hair dryer attachment, and in particular to such an attachment, for example a diffuser, volume brush, styling brush or the like, that may be attached to the hair dryer with improved versatility.

BACKGROUND TO THE INVENTION

A large number of types of hair dryer attachments are known, air diffusers, volume brushes and styling brushes being only a small representative sample. Such attachments may be fitted to the hot air outlet of the barrel of a hair dryer so that they may be used simultaneously with the hair dryer. This is particularly convenient since many of the functions of these attachments are only properly effective when carried out simultaneously with the act of drying wet hair. Providing an attachment to a hair dryer saves a user from having to use two separate tools and leaves one hand free.

Such attachments are normally releasably fitted to the air dryer so that when not required they may be removed and the dryer used conventionally, and in addition this allows different types of attachment to be interchanged.

A disadvantage, however, of this type of attachment is that they are fixed in position on the end of the hair dryer barrel. In some respects this gives slightly less flexibility and ease of use in comparison with a completely separate tool. In particular it is not easy to adjust the position of the attachment relative to a user's head. For example, in some circumstances the tool may work best when it is in full contact with the user's head, but this may require the dryer to be held in an uncomfortable position.

SUMMARY OF THE INVENTION

According to the present invention there is provided an attachment for a hair dryer comprising, means for releasably attaching said attachment to a hair dryer barrel, and means for allowing adjustment of the position of said attachment relative to the axis of said hair dryer barrel.

Viewed from another aspect the present invention provides an attachment for a hair dryer comprising, a connection member having first and second portions, said first portion comprising a substantially tubular member adapted to fit in use to the end of a hair dryer barrel and said second portion comprising a part-spherical portion, said first and second portions being disposed on an axis corresponding in use to the axis of said hair dryer barrel, and said hair dryer attachment further comprising a tool member having a part-spherical portion complementary to said part-spherical portion of said connection member and adapted to closely engage therewith whereby said tool member is permitted to move through a range of angles relative to said axis of said connection member.

By means of this arrangement the complementary part-spherical surfaces define a "ball-and-socket" joint that allows the tool member, ie the actual working portion of the attachment, to swivel about the axis of the hair dryer barrel. In addition, not only may the attachment move through an angle away from the axis, but furthermore the attachment may rotate about the axis of the hair dryer barrel. To achieve this the two complementary part-spherical surfaces preferably have substantially identical radii of curvature, with one being just fractionally larger than the other. Preferably the part-spherical surface of the tool member is the larger so that the part-spherical surface of the connection member is received therein.

Preferably the first portion of the connection member is sized so as to form a simple push-fit onto or into the outlet of the hair dryer barrel. However, if desired any other form of conventional connection and/or locking means may be provided between the first portion of the connection member and the end of the hair dryer barrel. For example the first portion of the connection member may be received within the outlet of the hair dryer barrel and be formed with resilient engaging members that are biased outwardly so as to engage with the interior of the barrel outlet.

Additionally disengagement prevention means may be provided on said part-spherical portions. Such means may, for example, comprise flange or partial flange portions formed on respective free edges of said part-spherical portions so as to mutually engage to prevent disengagement.

The attachment may comprise any form of conventional hair dryer attachment, for example: an air diffuser, a styling brush, a volume pick, a volume brush, a scalp massaging apparatus, an air acceleration nozzle and a pulsator. Other forms of attachment are also possible and within the scope of the present invention.

Although the invention is described herein with particular reference to a removable and releasable attachment, it will also be understood that the invention also extends to a hair dryer formed with an integral attachment.

BRIEF DESCRIPTION OF THE DRAWINGS

An embodiment of the invention will now be described by way of example and with reference to the accompanying drawings, in which.

DETAILED DESCRIPTION OF PREFERRED EMBODIMENT

Figure 1:
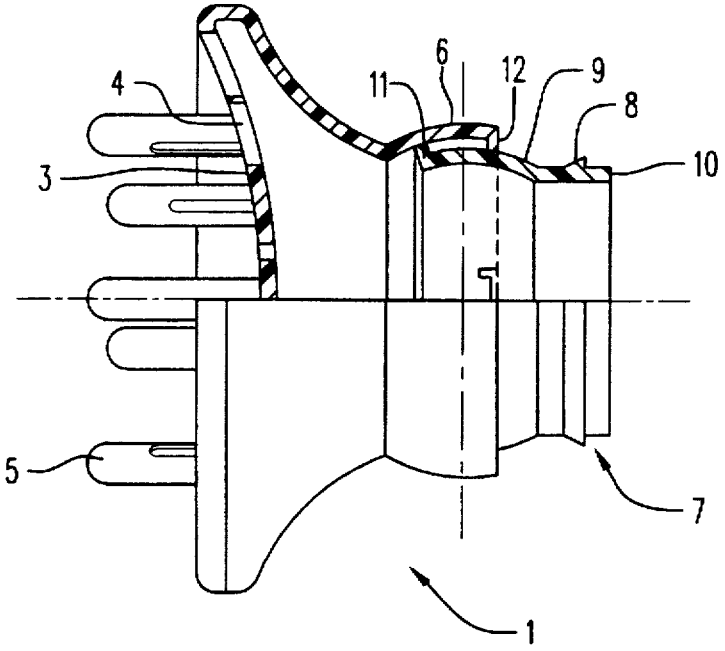
FIG. 1 is a view in cross-section of a first embodiment of the invention in the form of an air diffuser.

Referring firstly to FIG. 1 there is shown an attachment for a hair dryer in the form of a diffuser 1. It will be understood, however, that the invention is in no way limited to the attachment being a diffuser which is merely illustrated by way of example.

The function of a diffuser is to spread the stream of hot air over a wider area and to achieve this the attachment comprises a generally broad conical body 2 that diverges away from the hot air outlet of the hair dryer. Conical body 2 ends in a diffuser plate 3 which is formed with a plurality of apertures 4 for the discharge of hot air over a wide area. The diffuser plate 3 is also formed with a number of upstanding finger elements 5 that may be used to hold and separate strands of hair.

The conical body 2 and the diffuser plate 3 comprise a "tool portion" of the attachment, ie the portion designed to achieve the attachment's functional objective.

At the end of the conical body 2 is formed a part-spherical portion 6. Part-spherical portion 6 is symmetrically formed about the axis of the attachment and is formed with open ends to allow the flow of air therethrough.

The hair dryer attachment comprises a further portion 7 in the form of a means for fixing the attachment to the outlet portion of a hair dryer barrel. Fixing portion 7 comprises a first portion 8 having a substantially tubular cylindrical form adapted to fit tightly over the end of a hair dryer barrel. A simple push fit is adequate, though if desired any form of locking means may be employed to assist in securing the first portion 8 to the barrel. For example, the end of portion 8 may be provided with resilient locking members 10 adapted to engage the interior of the outlet of the hot air nozzle.

Fixing portion 7 also comprises a second portion 9 in the form of a part-spherical portion that is complementary to the part-spherical portion 6. In particular part-spherical portions 6 and 9 are centred on a common central point and have substantially identical radii. In practice, however, the radius of curvature of portion 9 is slightly smaller than that of portion 6 such that portion 9 may be received within portion 6 as is shown in FIG. 1. Similarly to part-spherical portion 6, portion 9 is formed with open ends to allow the flow of air therethrough.

Figure 2:
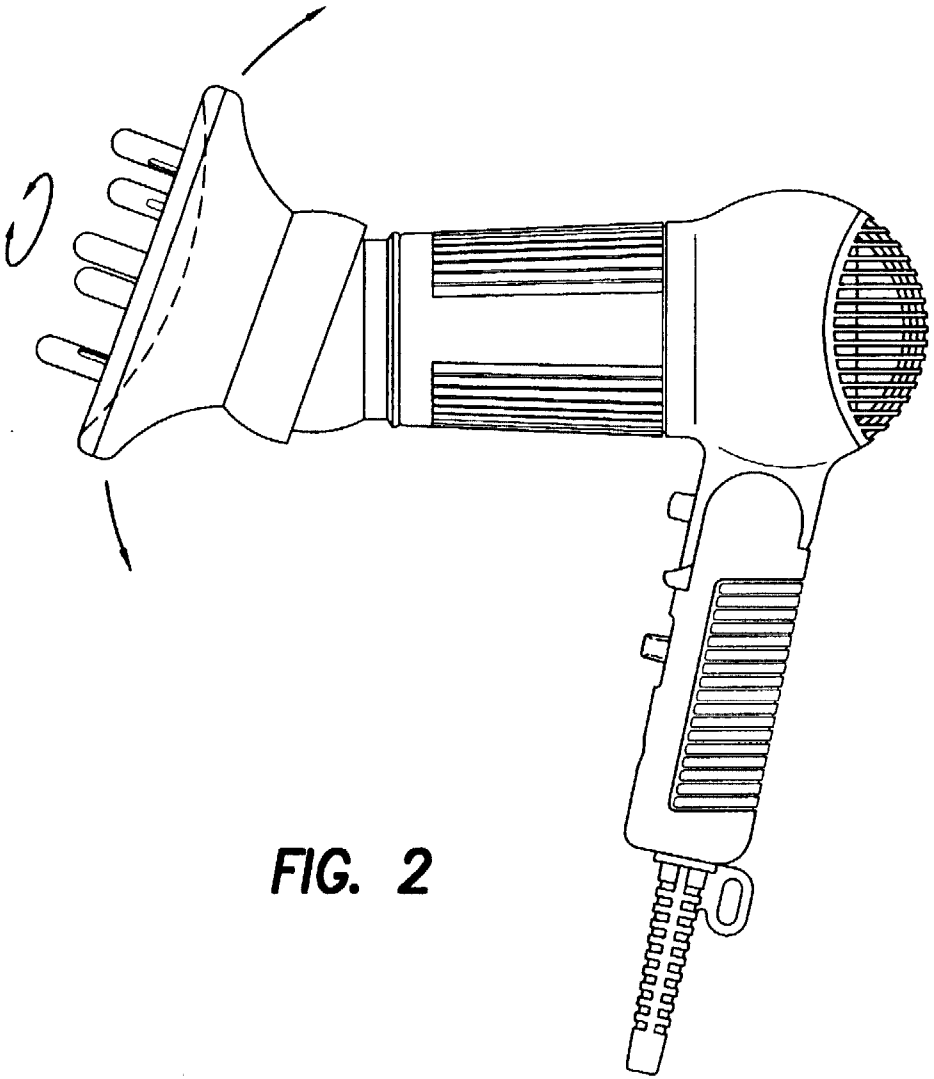
FIG. 2 is a side view of the attachment of FIG. 1 fixed in use to a hair dryer.

The function of the part-spherical portions will now be explained. Together they form a type of "ball and socket" joint that allows relative swivelling movement of the tool portion and the fixing portion. Treating the fixing portion 7 as fixed, the tool portion may swivel about the centre of the part-spherical portions 6 and 9 within a range of angles forming a cone with respect to the axis of the tool portion which in turn is the same as the axis of the fixing portion and in turn comprises the axis of the hot air outlet of the air dryer barrel. Thus, as is best seen in FIG. 2, the tool portion of the attachment is able to move through a wide range of angles relative to the hair dryer barrel. Furthermore the tool portion of the attachment is also allowed to rotate about the axis of the attachment/hair dryer barrel as is shown by the circular arrow in the Figures.

The range of movement of the attachment is dictated by the angular extent of the part-spherical portions. In the embodiment illustrated each part-spherical portion has an angular extent of approximately 45° and this is sufficient to give a wide range of movement. A greater angular extent would give a greater range of movement, but this would be at the expense of obstructing the flow of air through the attachment. To prevent any possibility of accidental disengagement between the two part-spherical portions one of them, for example the portion 9, may be provided with an upstanding flange 11 around the open end of the portion 9 (ie the end remote from the hair dryer outlet in use), and the other portion 6 may be provided with a corresponding flange 12, or an at least partial flange, or even just a series of projections, about the open edge of that portion 6 (ie the edge facing the hair dyer barrel outlet in use) such that the two flange portions 11, 12 may engage one another and prevent the part-spherical portions from becoming disengaged.

Figure 3:
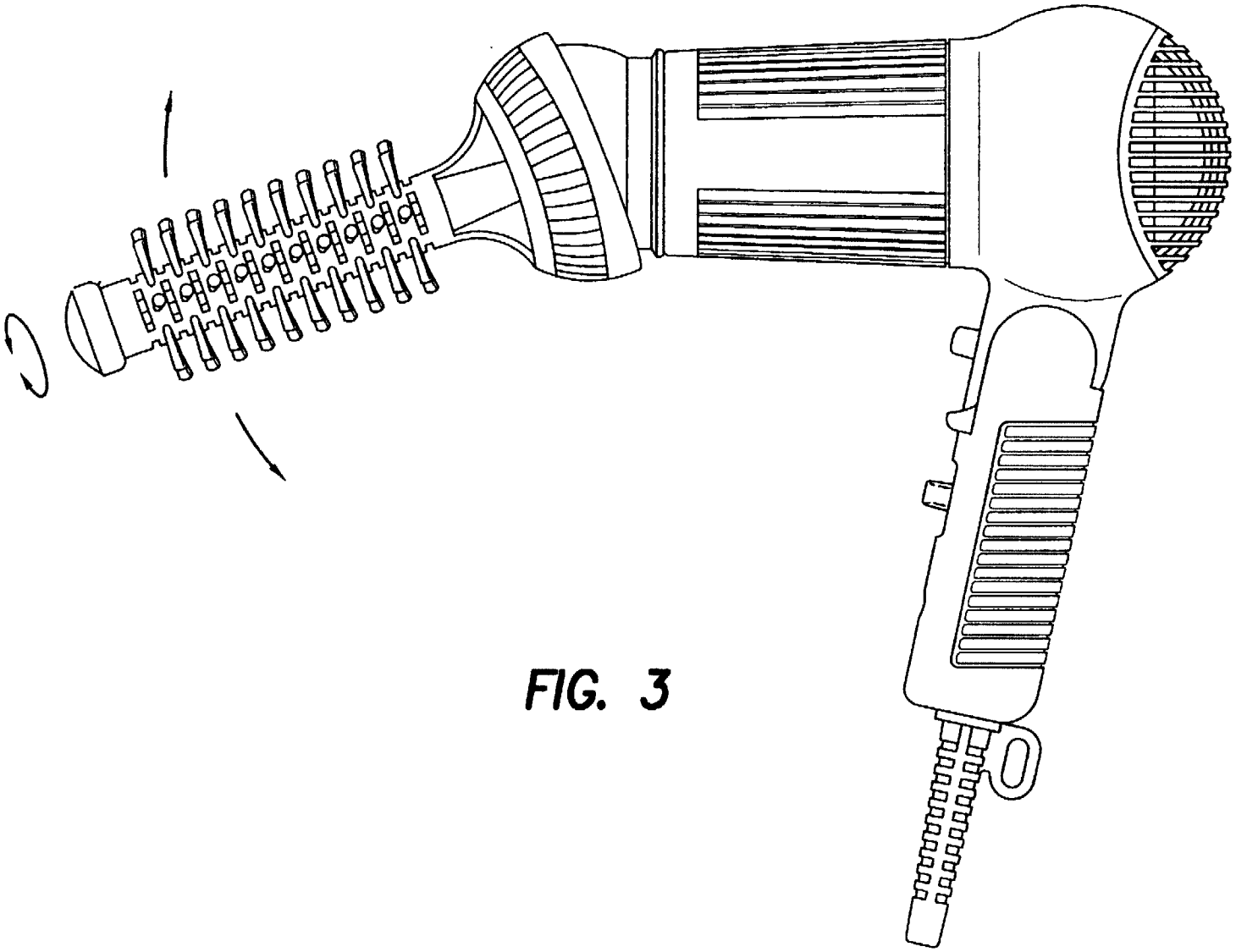
FIG. 3 is a view similar to FIG. 2 where said attachment comprises a styling brush.
Figure 4:
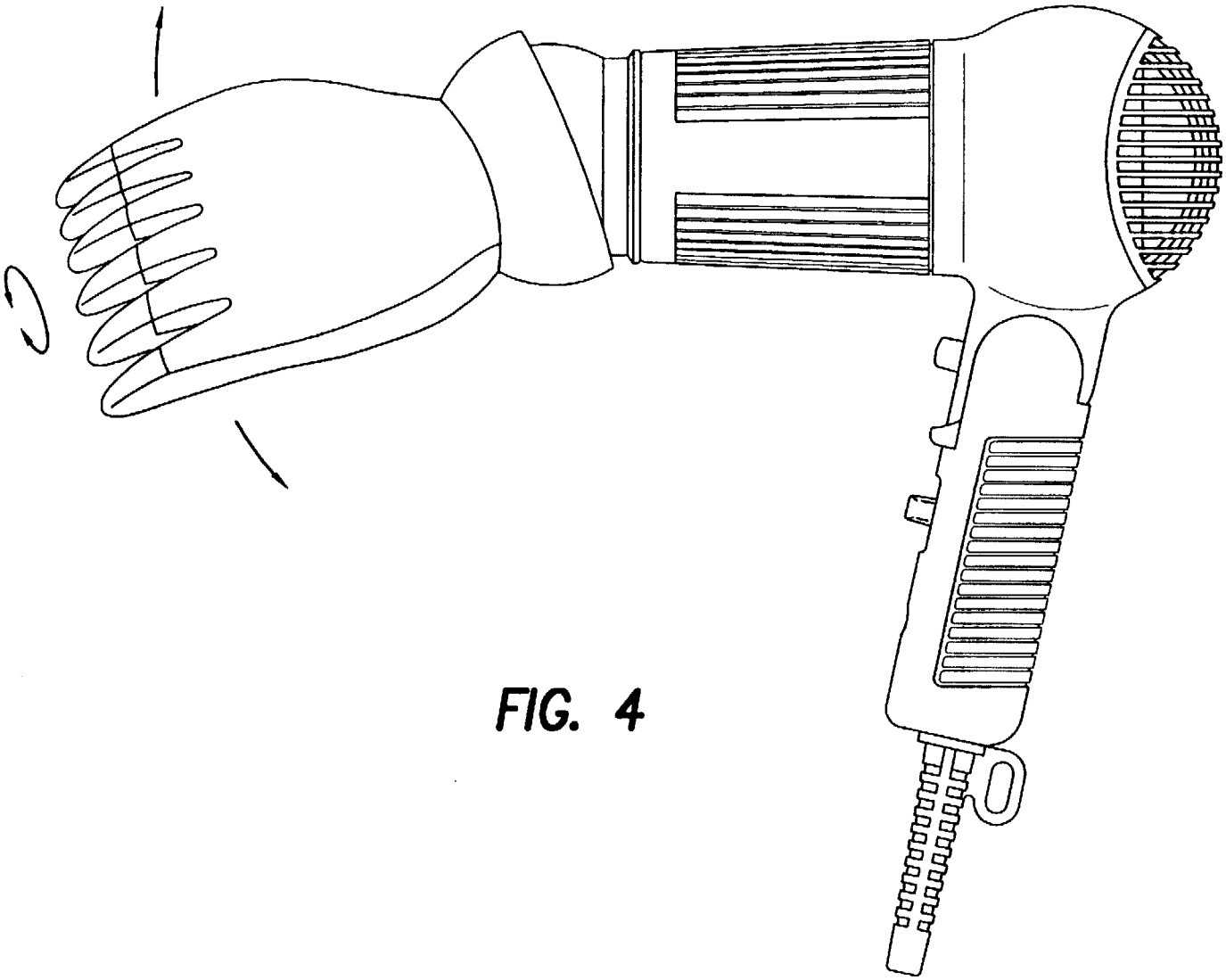
FIG. 4 is a view similar to FIG. 2 where said attachment comprises a scalp massaging apparatus.
Figure 5:
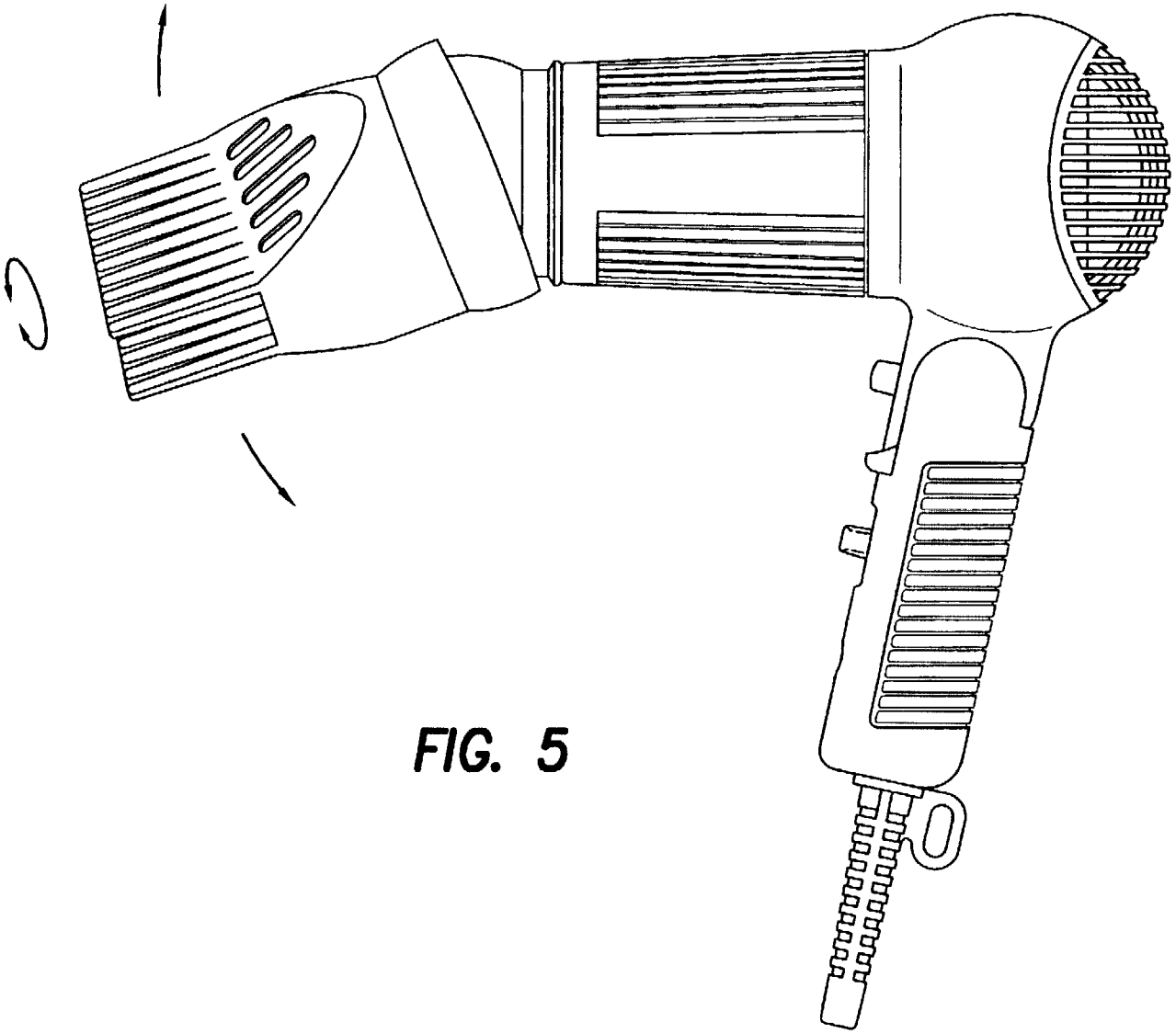
FIG. 5 is a view similar to FIG. 2 where said attachment comprises a volume pick.
Figure 6:
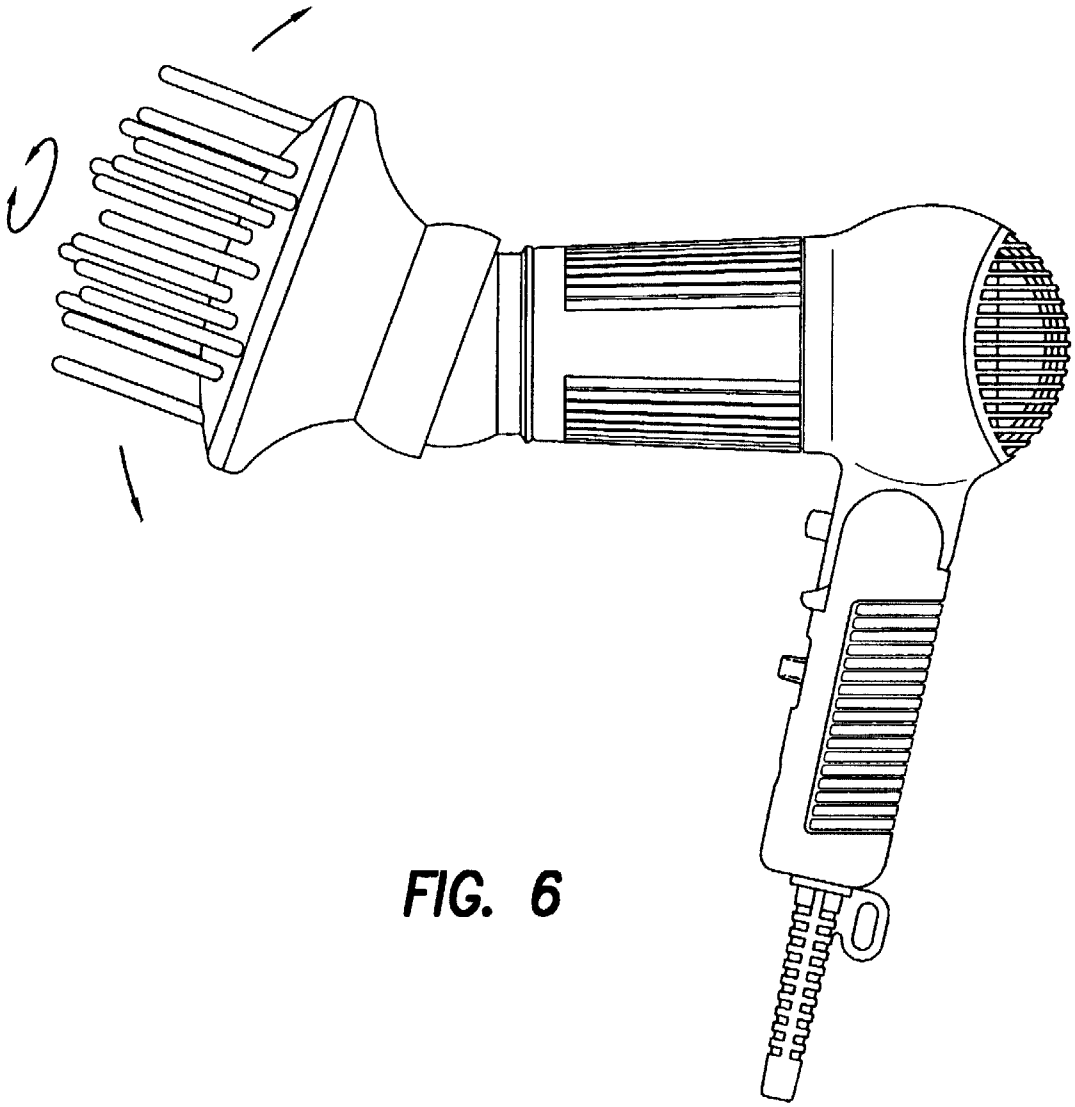
FIG. 6 is a view similar to FIG. 2 where said attachment comprises a volume brush.
Figure 7:
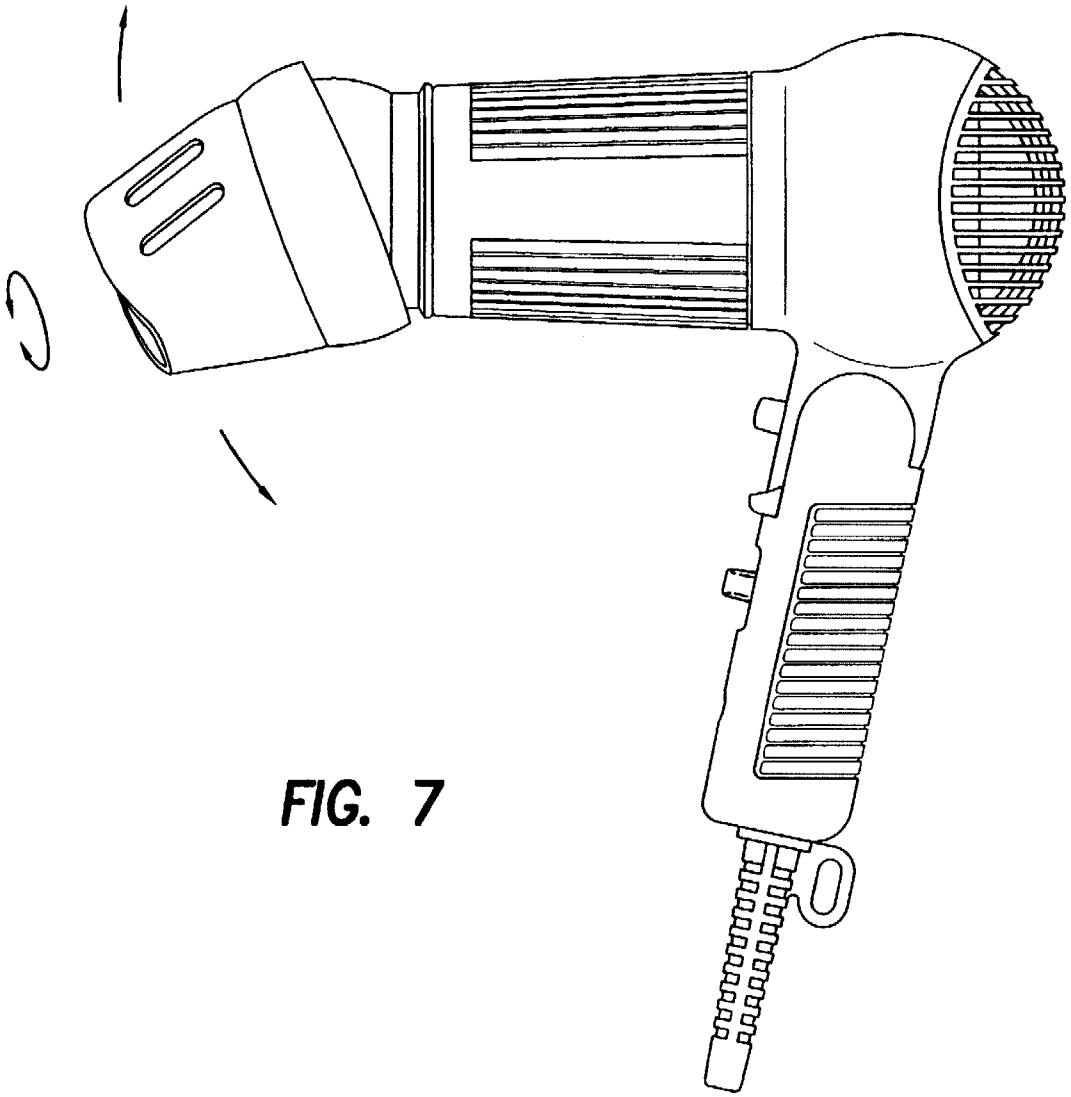
FIG. 7 is a view similar to FIG. 2 where said attachment comprises an air acceleration nozzle.
Figure 8:
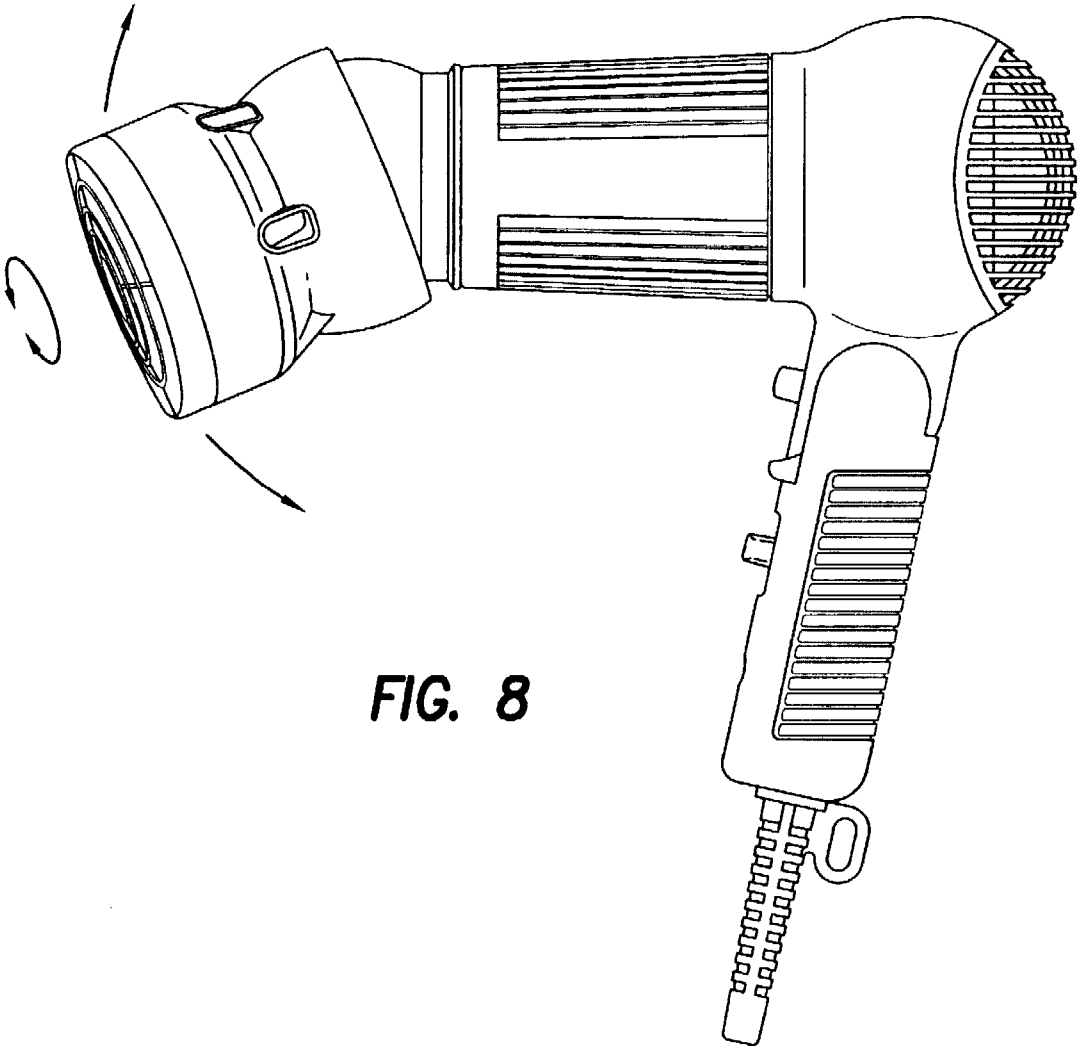
FIG. 8 is a view similar to FIG. 2 where said attachment comprises a pulsator.

Although the invention has been described in the above with reference to the attachment being an air diffuser, it will of course be understood that the invention is not so limited and could equally be applied to a wide range of hair dryer attachments. For example, FIG. 3 shows the present invention applied to a styling brush, FIG. 4 to a scalp massaging attachment, FIG. 5 to a volume pick, FIG. 6 to a volume brush, FIG. 7 to an air acceleration nozzle, and FIG. 8 to a pulsator.

I claim:

1. An attachment for a hair dryer comprising, means for releasably attaching said attachment to a hair dryer barrel, and means for allowing adjustment of the position of said attachment relative to said barrel, which comprises first and second members each being formed with a respective part-spherical portion, said respective part-spherical portions being disposed one within the other so as to form a rotatable joint allowing relative movement of said first and second members.

2. An attachment as claimed in claim 1 wherein said first member comprises a tool portion for performing the operative function of said attachment, and said second member comprises a connection member for fixing said attachment to a hair dryer barrel in use.

3. An attachment as claimed in claim 2 wherein locking means are provided to facilitate fixing of said second member to said hair dryer barrel.

4. An attachment as claimed in claim 1 wherein said part-spherical portions are formed with means for preventing disengagement of said part-spherical portions.

5. An attachment for a hair dryer comprising, a connection member having first and second portions, said first portion comprising a substantially tubular member adapted to fit in use to the end of a hair dryer barrel and said second portion comprising a part-spherical portion, said first and second portions being disposed on an axis corresponding in use to the axis of said hair dryer barrel, and said hair dryer attachment further comprising a tool member having a part-spherical portion complementary to said part-spherical portion of said connection member and adapted to closely engage therewith whereby said tool member is permitted to move through a range of angles relative to said axis of said connection member and is permitted to rotate about said axis.

* * * * *